United States Patent [19]

Scribner

[11] 4,267,950

[45] * May 19, 1981

[54] STOCK FEEDER FOR PUNCH PRESSER AND THE LIKE

[76] Inventor: Albert W. Scribner, Six Country Club Rd., Darien, Conn. 06820

[ * ] Notice: The portion of the term of this patent subsequent to Feb. 28, 1995, has been disclaimed.

[21] Appl. No.: 878,383

[22] Filed: Feb. 16, 1978

Related U.S. Application Data

[63] Continuation of Ser. No. 679,490, May 10, 1976, Pat. No. 4,076,161.

[51] Int. Cl.[3] ..... B65H 17/36; B65H 17/44

[52] U.S. Cl. ..... 226/146; 226/151; 226/162; 226/195

[58] Field of Search ..... 226/144, 146, 147, 151, 226/162, 163, 165, 167, 195

[56] References Cited

U.S. PATENT DOCUMENTS

| | | | |
|---|---|---|---|
| 3,485,430 | 12/1969 | Scribner | 226/162 X |
| 3,937,379 | 2/1976 | Navwid et al. | 226/162 X |
| 4,076,161 | 2/1978 | Scribner | 226/162 |

FOREIGN PATENT DOCUMENTS

| | | | |
|---|---|---|---|
| 1810709 | 6/1970 | Fed. Rep. of Germany | 226/162 |
| 1002754 | 8/1965 | United Kingdom | 226/162 |
| 1151162 | 5/1969 | United Kingdom | 226/162 |

*Primary Examiner*—David A. Scherbel

[57] ABSTRACT

A low cost pneumatic stock feeder for punch presses and the like wherein a one-piece U-shaped main frame is provided for supporting and guiding a reciprocating feed slide. One end of a stock gripper bar is pivotally secured to the feed slide while the other end thereof is adapted to be actuated by a fluid motor carried by said feed slide whereby an efficient mechanical advantage is afforded for the stock gripping action. A continuously acting friction braking means is provided for engaging just the longitudinal side corners of the stock material so that the latter may be yieldably held during the time when the gripper bar is released and so that there is a minimum of marring or scratching of that portion of the stock material from which parts are to be stamped.

1 Claim, 5 Drawing Figures

STOCK FEEDER FOR PUNCH PRESSER AND THE LIKE

PRIOR PATENT APPLICATIONS

This application is a continuing application of Ser. No. 679,490, filed May 10, 1976, and entitled "Stock Feeder for Punch Presses and the Like", now U.S. Pat. No. 4,076,161.

BACKGROUND OF THE INVENTION

Certain types of commercially available pneumatically operated strip feed devices, such as those illustrated in U.S. Pat. No. 3,329,327, have become widely used in order to accurately and rapidly feed strip stock into the work station of a punch press or the like. These devices however are made up of a relatively large number of parts which tend to increase the costs of fabrication, assembly, adjustment and service of such feeders. Further the many parts involved can adversely affect the mechanical efficiency, reliability and/or durability of such devices as well as their air consumption rates.

SUMMARY OF THE INVENTION

The proposed arrangement for the present feeder drastically reduces the cost of a pneumatic stock feeder by greatly reducing the number of individual parts used as compared to that utilized in the above noted conventional types of feeders; and those parts that are used are constructed and arranged so as to not only be less expensive to make and assemble but also to synergistically cooperate to substantially match the stock feeding performance afforded by said more expensive conventional devices.

In the present feeder a unitary U-shaped main frame is provided which supports a reciprocating feed slide having a pivoted gripper bar mounted thereon which straddles the stock and which is actuated by a double-acting fluid motor so that the bar gripping action has a mechanical advantage of about two. The fluid pressure operated stationary stock clamp arrangement normally used in said conventional devices is entirely eliminated, and a simple continuously acting braking means is provided in place thereof to positionally stabilize the strip stock while the stock is not otherwise being gripped by said bar. This braking means serves to apply frictional braking forces only to the longitudinal side corners of the strip stock being fed thereby minimizing any scratching of the strip surfaces that might otherwise occur.

The primary object of the invention is thus to provide a novel construction and operation for a pneumatically operated feeder whereby the cost thereof may be greatly reduced while not substantially reducing the performance levels thereof.

Other objects will become apparent as the disclosure progresses.

Figure 1:
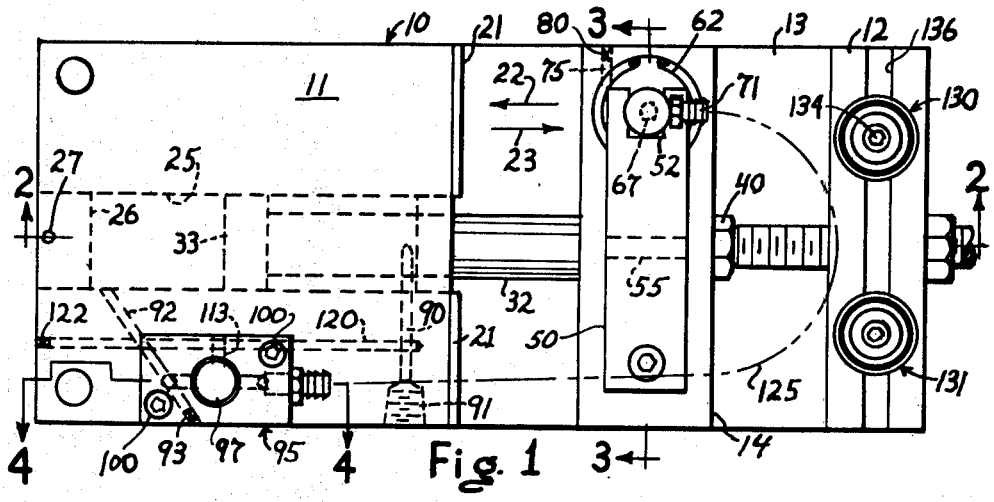
FIG. 1 is a plan view of the instant apparatus.
Figure 3:
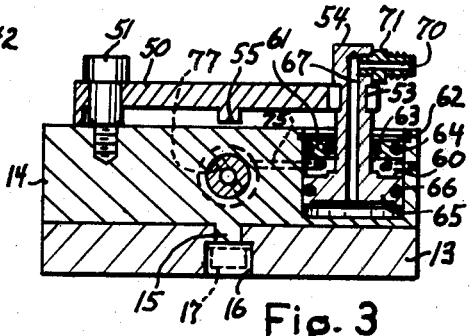
FIG. 3 is a sectional view taken along section line 3—3 of FIG. 1.
Figure 4:
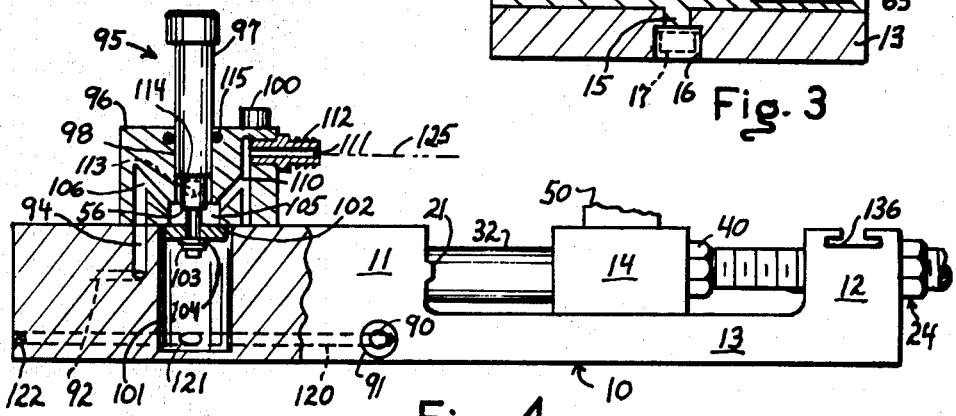
FIG. 4 is a front elevational view taken in partial section along line 4—4 of FIG. 1.

The present feeder is provided with a generally rectangular U-shaped one-piece main frame defined by a base block 10, FIGS. 1 and 4, that comprises a main body portion 11, an end block portion 12, and a plate-like portion 13 that integrally interconnects the lower regions of said main body and end block portions. As used herein the term "base block" means an integral one piece element consisting of one single part as opposed to a composite of two or more parts that are secured together. A feed slide 14 is reciprocally mounted on the flat upper surface of said plate-like portion 13 of the main frame; the bottom of said feed slide being formed with a depending key or guide means 15, FIG. 3, that is received in a longitudinal T-slot 16 formed in said plate-like frame portion 13. A screw 17, FIG. 2, and an associated washer 18 are secured to the bottom of said key 15 so as to retain the latter in said slot and to permit said feed slide 14 to partake of smooth straight-line reciprocating motion on said frame in feed and index directions 22 and 23, FIG. 1, respectively. For clarity of illustration screw 17 and washer 18 are shown in dotted lines in FIG. 3. The effective length of the feed stroke of the feed slide 14 may be varied by means of a conventional type screw and jam-nut arrangement 24 that is threadedly carried by the end block portion 12 of said main frame 10.

Figure 2:
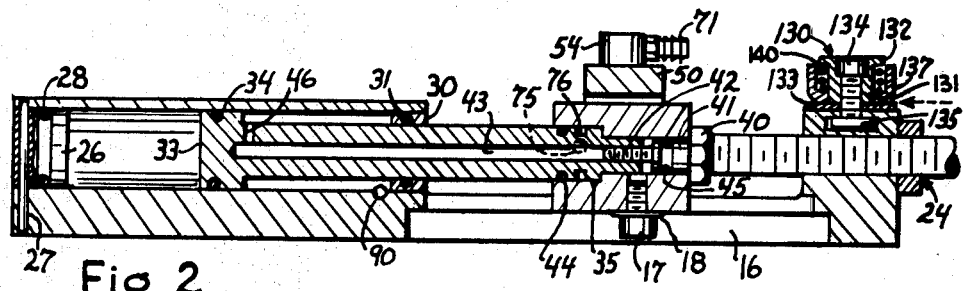
FIG. 2 is a sectional view taken along section line 2—2 of FIG. 1.

The feed slide 14 is adapted to be reciprocally actuated by a main double-acting fluid motor that includes a main cylinder bore 25 formed through said main body portion 11 of said frame; the forward end of said bore being closed by a cylindrical plug member 26 which is removably secured to said main body frame portion by any suitable means such as a roll pin 27 and which is provided with a suitable fluid seal such as an O-ring 28. Into the opposite end of the main cylinder bore 25 there is press-fitted a collar 30 that is provided with a suitable internal fluid seal, such as an O-ring 31, that slidably engages the outer cylindrical walls of a piston rod 32. The forward or left end of the piston rod 32, as seen in FIG. 2, is integrally connected to a piston 33 that is provided with a suitable fluid seal, such as an O-ring 34, that slidably engages the walls of said main cylinder bore 25. The opposite shouldered end of the piston rod 32 extends into a counter-bored hole 35, FIG. 2, that is centrally formed through the said feed slide; said feed slide being secured to said piston rod by means of a screw type fastener having a head portion 40, a neck portion 41 and a reduced threaded end portion 42 that threadedly engages the adjacent end of an axial passage 43 formed through said piston rod 32. The piston rod and neck portion 41 of said fastener are each provided with suitable fluid seals, such as O-rings 44 and 45 respectively, which cooperate with the walls of said counter-bored hole 35 formed through said feed slide 14. A radially disposed hole 46, FIG. 2, formed through the piston rod walls adjacent the piston 33 serves to communicate the rod end of the main cylinder bore 25 with said axial passage 43 in the main piston rod.

The feed slide 14 is provided with a stock gripping means and an associated double-acting fluid operated gripper motor. The stock gripping means includes a gripper bar 50 that is pivotally secured at its left end, as seen in FIG. 3, to the feed slide by means of a conventional shoulder screw 51; the screw shoulder and the associated hold in the gripper bar being relatively dimensioned so as to permit a limited amount of pivotal movement by said bar about its left end and in the plane of FIG. 3. The right end of said bar is slotted as shown at 52, FIG. 3, of a piston rod 54 of the said double-acting gripper motor carried by said feed slide. Depending from the central region of the lower side of the gripper bar 50 is an integrally formed rib 55 that is adapted to move with bar 50 into and out of gripping engagement with the stock to be fed; the effective central location of said rib along said pivoted bar 50 affording the latter a stock gripping action having a mechanical advantage of approximately two. Said gripper motor includes a cylindrical bore 60 formed in the right hand end, as seen in FIG. 3, of the feed slide; the upper end of said bore being closed by a collar 61 which is retained in said bore by any suitable means such as an internal fastener ring 62, and which is provided with suitable internal and external fluid O-ring seals 63, 64 as shown in FIG. 3. The lower end of piston rod 54 is connected to a piston 65 that is provided with a suitable seal, such as an O-ring 66, that slidably engages the walls of said cylinder bore 60. The piston 65 and piston rod 54 are formed with an axial passage 67 that communicates the lower end of the cylindrical bore 60 with an axial passage 70 formed through a suitable conventional type barbed fitting 71 that radially extends from and is secured to the upper end of said piston rod 54. The rod end of the gripper motor cylinder bore 60 communicates with the said axial passage 43, FIG. 2, formed in the main piston rod 32 through an air line or passage 75 which intersects the said upper rod end of the gripper motor cylinder bore 60 and which communicates at its inner end with the said counterbored passage 35 formed through said feed slide; this inner end of passage 75 being disposed substantially coplanar with an annular groove 76 formed around said main piston rod 32. The groove 76 communicates with said axial passage 43 through a dimetral hole 77, FIG. 3, formed through the walls of said main piston rod 32. The outer end of said passage 75 is plugged as indicated at 80 in FIGS. 1 and 3. For clarity of illustration the fitting 71 is shown in FIG. 3 as being in the plane of said section line 3—3 as opposed to its actual position illustrated in FIGS. 1 and 2.

The rod end of the main cylinder bore 25 is adapted to be continuously supplied with pressure fluid through an air line or passage 90 that communicates with a threaded inlet aperture 91, while the head end of the bore 25 communicates with and is serviced by an air line 92 which is plugged at its outer end as indicated at 93, FIG. 1, and which communicates with a vertically disposed air line 94, FIG. 4, also formed in the main body portion of the main frame.

The above described main and gripper double-acting fluid motors are controlled by a single three-way valve means 95, FIGS. 1 and 4, which comprises a valve block 96 and a valve stem 97 that is axially slidably mounted in a bore or passage 98 formed through said valve block. The valve block is secured to the main body portion 11 of the main frame by any suitable fastening means such as screws 100 and is disposed above and covers a vertical valve bore 101 formed in said main body portion 11. Disposed in said bore is a valve disc 102 which has a slightly smaller diameter than that of bore 101 and which is axially slidably mounted on the reduced lower end portion of said valve stem 97; said disc being retained on said stem by means of a conventional type retainer ring 103. An O-ring seal 104 is also disposed on and snugly fits around said reduced stem portion between said disc and said retainer ring. The flat radial outer portion of the upper surface of the disc 103 is adapted to valvingly engage and seat on that annular portion of the flat lower surface of valve block 96 surrounding the lower end of the counter-bored opening or chamber 105, FIG. 4, formed in said valve block. One end of two legged fluid pressure line 106 is formed in said valve block communicates with the said chamber 105 while the other end thereof communicates with the upper end of said vertical air line 94. One end of another fluid pressure line 110 formed in the valve block also communicates with said chamber 105 while the other end thereof communicates with an axial passage 111 formed in a conventional type barbed fitting 112 that is secured in the upper right side wall of the said valve block as seen in FIGS. 1 and 4. The valve block 96 is formed with an exhaust line or port 113, FIGS. 1 and 4, that communicates with said valve block passage 98 at a point just below the position of a shoulder 114 formed on the valve stem when the latter is disposed in its normal upward position indicated in FIG. 4. The valve block is also provided with a suitable internal O-ring seal 115 that is slidably engaged by the walls of said valve stem 97.

A valve supply line 120, FIGS. 1 and 4, is formed in the body portion 11 of said main frame; the inner end of line 120 communicating with said supply line 90, the intermediate portion thereof intersecting the said valve bore 101, as indicated at 121 of FIG. 4, and the outer end thereof being plugged as indicated at 122. The said barbed fitting 112 on the valve block is coupled to the barbed fitting 71 of the gripper motor carried by the feed slide by means of any suitable flexible plastic tubing as indicated by the dashed line 125 of FIG. 1.

A stock guide and braking means is provided for continuously applying a friction drag force to the strip stock being moved through the feeder; such means including a pair of similar laterally adjustable units 130, 131, FIG. 1. In that each such unit is constructed and operates in a similar manner a description of one thereof will suffice here. Unit 130, which for convenience of illustration is shown in dimetral section in FIG. 2, comprises a tubular stock guide or stud member 131 that is formed with an upper flange 132 and overlies a centrally apertured washer 133. The stud and washer are adapted to be clamped against the upper surface of the end block portion 12 of said main frame by means of a screw 134 that has its lower end threadedly engaged with a square nut 135 that is disposed in a transverse T-slot 136, FIG. 4, formed in said end block frame portion 12. Axially slidably mounted on said stud member 131 is a cup-shaped stock engaging collar 137 that is adapted to be biased downwardly towards washer 133 by means of a compression spring 140 that is operatively disposed between said stud flange 132 and said collar 137.

Figure 5:
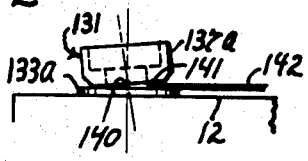
FIG. 5 is a diagrammatic view illustrating the braking means as viewed from the right end, as seen in FIG. 1, of the feeder.

The stock guide and braking means 131 is diagrammatically illustrated in FIG. 5, with parts corresponding to those just described for braking means 130 being numbered the same but with a subscript "a" added thereto. The center hole through the bottom wall of collar **137*a* is dimensioned with respect to the associated supporting stud so that collar 137*a* is capable of partaking of a limited amount of pivotal movement about an axis which passes through point 140, FIG. 5, and which is substantially parallel to the longitudinal axis of the feeder; this pivotal movement being in a plane that is substantially parallel to the plane of section line 3—3 of FIG. 1. Under these conditions a substantial frictional braking or drag force is continuously applied by said collar 137***a* to the upper left longitudinal side corner edge 141 of said stock as seen in FIG. 5; said braking force resisting, to substantially equal degrees, movement of said stock in either longitudinal direction through the feeder. The corner edge 141 as seen in FIG. 5 is that upper corner edge effectively defined by the vertex of the top and left side surfaces of the stock. This braking arrangement acting only on the opposite longitudinal side edges of the stock thus minimizes the scratching or marring of the central portion of the stock from which parts are to be stamped.

In the operation of the present apparatus the stock guide and braking means 130, 131 are first positionally adjusted along said T-slot 136 so as to properly accommodate the width of the particular stock to be fed and to locate said stock along the center longitudinal line of the feeder. Said stock is first threaded between the collars 137 and 137*a* and their associated washers, 133, 133*a* respectively and then between the top of the feed slide 14 and the rib 55 of gripper bar 50. Air or other fluid pressure is then continuously supplied (a) to the rod end of the main cylinder bore 25 through said aperture 91 and supply line 90, (b) to the valve bore 101 through line 120, and (c) to the rod end of the gripper motor from the rod end of the main fluid motor through lines 46, 43, 77, groove 76, and passage 75. The air pressure in the valve bore causes the valve disc 102 and stem 97 to be moved to and maintained in their normal upper positions shown in FIG. 4. In this condition of the valve means 95 the chamber 105 is isolated from valve bore 101, and together with the lines 92, 94 and 106 to the head end of the main cylinder bore 25 communicates with the said exhaust port or passage 113 in the valve block. At the same time the lower or head end of the gripper motor on the feed slide is in similar communication with said exhaust port through air lines and passages 67, 70, the flexible tube 125, and lines 111 and 110 and chamber 105. Thus in said normal condition of the valve and while fluid pressure is being continuously applied to the rod ends of said fluid motors the head ends of said double-acting fluid motors will be exhausted, whereby the gripper motor will pull down the adjacent end of gripper bar 50 so that rib 55 grips the stock and the main fluid motor will move the feed slide through a stock feed stroke in said direction 22. The limit of feed movement of the slide 14 is determined by engagement of the latter with the horizontally disposed coplanar ribs 21, FIGS. 1 and 4, integrally formed on said main frame portion 11.

When the control plunger or valve stem 97 is depressed the valve stem shoulder 114 will first pass across and cover the inner end of said exhaust passage 113, and shortly thereafter the valve stem shoulder 56 will engage the top of valve disc 102 and displace the latter downwardly in the valve bore 101. This unseating of the valve disc will then allow air pressure from said valve bore 101 to flow to the head ends of said main and gripper motors through said lines and passages and this will cause the end of the gripper bar 50 to be elevated thereby releasing the stock and the main cylinder to move the feed slide in an index or non-feed direction 23, FIG. 1. During this index stroke of the feed slide the stock is yieldably held or clamped in a stationary or stabilized position by means of said yieldably biased clamping collars 137, 137*a* of said guide and braking means 130 and 131 respectively. When the valve stem 97 is allowed to be moved upwardly by the continuous air pressure in valve bore 101 the valve disc 102 will first seat again on the bottom surface of said valve block to cut off further flow of air pressure to chamber 105 and shortly thereafter as the valve stem again reaches its normal FIG. 4 position as determined by engagement of the O-ring 104 with the bottom of the valve disc 102, the valve stem shoulder 114 will uncover the exhaust port 113 so that the head ends of said main and gripper fluid motors may be exhausted whereby said feed slide again partakes of a feed stroke against the continuous yieldable braking action of the said spring biased collars 137, 137*a*. Any suitable restriction may be used at any convenient point along air lines 106, 94 and 92 to control the speed of operation of the main fluid motor and the timing of operation of said main fluid motor relative to the operating of the gripper motor as is well understood in the art.

It will be readily seen that ther are far less parts in the instant feeder than in said currently available types of air feeders such as are illustrated in said U.S. Pat. No. 3,329,327. For example, the number of fluid motors here is reduced from five to two, the frame is now arranged in one rigid piece thereby reducing the alignment and other problems for the feed slide motion with respect to the main cylinder, and the air-powered stationary stock clamp means normally utilized is completely eliminated. These features contribute to the simplicity, greatly reduced cost, ease and speed of assembly and service, and extended durability and reliability of the instant feeder. With the present combination not only is the number of parts greatly reduced but those that are used can now be made by low cost production methods; for example the main frame can now be cut from extruded lengths of aluminum, and the majority of the remaining parts that are not commercially available may be made on high volume automatic screw machines.

I claim:

1. A pneumatically operated feeder for intermittently advancing stock into the work station of a punch press or the like:

comprising a one-piece U-shaped generally rectangular frame that includes a main block portion, an end block portion and an intermediate plate-like portion that integrally interconnects the lower regions of said main block portion and said end block portion;

said main block portion being formed at its side with an air supply inlet aperture;

laterally adjustable stock guide means carried by said frame at said end block;

a feed slide mounted for reciprocating movement on said plate-like frame portion, the lower side of said feed slide being provided with generally flat surfaces that slidably engage corresponding generally flat surfaces on the upper side of said plate-like frame portion;

retaining means for retaining said feed slide on said plate-like frame portion for longitudinal reciprocatory movement;

stock gripping means carried by said feed slide;

fluid motor means carried by said feed slide for actuating said stock gripping means;

a main fluid motor means disposed in said main block portion and having a movable piston and piston rod, the outer end of the later being connected to said feed slide; and valve means communicating with said air inlet aperture for controlling the operation of both of said fluid motor means and including a valve and a movable control member therefor mounted at one lateral side of said main block portion.

* * * * *